US005718261A

United States Patent [19]

Chen

[11] Patent Number: 5,718,261

[45] Date of Patent: Feb. 17, 1998

[54] CLEANING SOLUTION DISPENSER FOR USE IN A WATER TANK, AND WATER TANK CAPABLE OF DISCHARGING MIXTURE OF WATER AND CLEANING SOLUTION

[75] Inventor: Cheng-Chang Chen, Taipei Hsien, Taiwan

[73] Assignee: Bobson Hygiene International Inc., Taipei Hsien, Taiwan

[21] Appl. No.: 596,009

[22] Filed: Feb. 6, 1996

[51] Int. Cl.[6] ..... E03D 9/03; F16K 21/20; F16K 31/22

[52] U.S. Cl. ..... 137/393; 4/227.3; 137/433; 137/453; 222/67; 222/437; 222/457

[58] Field of Search ..... 4/222, 223, 224, 4/227.2, 227.3, 227.4, 227.5, 228.1, 309; 137/393, 433, 453, 454; 222/67, 437, 457, 479

[56] References Cited

U.S. PATENT DOCUMENTS

| | | | |
|---|---|---|---|
| 1,623,132 | 4/1927 | Pennell et al. | 4/309 |
| 2,065,181 | 12/1936 | French | 4/227.3 |
| 2,092,072 | 9/1937 | Ingraham | 137/433 |
| 2,303,913 | 12/1942 | Collinge et al. | 4/224 |
| 2,351,580 | 6/1944 | Beckman | 4/227.4 |
| 3,254,797 | 6/1966 | Porter | 4/227.3 |
| 3,358,299 | 12/1967 | Maude | 4/309 |
| 3,359,063 | 12/1967 | Maude | 4/309 |
| 3,668,716 | 6/1972 | O'Hara et al. | 4/309 |
| 3,913,151 | 10/1975 | Keimig | 4/227.3 |
| 4,209,863 | 7/1980 | Lindauer | 4/227.4 |
| 4,209,864 | 7/1980 | Lindauer | 4/227.4 |
| 4,212,089 | 7/1980 | Lindauer | 4/227.4 |
| 4,429,809 | 2/1984 | Bousgarbies | 4/227.3 |
| 5,488,742 | 2/1996 | Liao | 4/227.3 |

*Primary Examiner*—George L. Walton
*Attorney, Agent, or Firm*—Sughrue, Mion, Zinn, Macpeak & Seas, PLLC

[57] ABSTRACT

A cleaning solution dispenser installed in a water tank 2 includes a container 3 and a tubular flow regulator 4. The container receives cleaning solution therein and is formed with a downwardly opening outlet 31. The flow regulator extends into the outlet of the container and is divided by a partition plate 40 into upper and lower chambers 41, 42. The upper chamber has a closed top end and a surrounding wall formed with at least one radial port 43 opening adjacent to the partition plate. The flow regulator further has first and second tubes 44, 45 which extend upwardly from the partition plate into the upper chamber. The second tube is shorter than the first tube and has a top end which is located at a level higher than that of the port opening. The first and second tubes communicate the upper chamber with the lower chamber. The lower chamber has an open bottom end. The cleaning solution in the container flows through the flow regulator via the port opening, the upper chamber, the second tube and the lower chamber when air pressure in the upper chamber is less than pressure in the container.

8 Claims, 5 Drawing Sheets

CLEANING SOLUTION DISPENSER FOR USE IN A WATER TANK, AND WATER TANK CAPABLE OF DISCHARGING MIXTURE OF WATER AND CLEANING SOLUTION

BACKGROUND OF THE INVENTION

1. Field of the Invention

The invention relates to a dispenser, more particularly to a cleaning solution dispenser for use in a water tank.

2. Description of the Related Art

Urinals and toilet bowls with flushing devices are known in the art. However, a residue layer generally forms on the surface of the urinal (or toilet bowl) even when the latter is flushed with water after each use. The residue layer cannot be removed without scrubbing. In order to minimize the formation of the residue layer and to facilitate cleaning of the urinal (or toilet bowl), a cleaning solution is usually mixed with the water that is discharged to the urinal (or toilet bowl) during flushing.

FIG. 1 illustrates a conventional way of dispensing cleaning solution to a urinal 11. A container 13 of cleaning solution is installed in a water pipe unit 12 of the urinal 11. Water from the pipe unit 12 mixes with the cleaning solution in the container 13 so that, when the urinal 11 is flushed, the mixture of water and cleaning solution is discharged to the urinal 11.

In the aforementioned way of dispensing the cleaning solution, it is noted that the concentration of the cleaning solution decreases rapidly after repeated flushing of the urinal 11. Thus, the high concentration of cleaning solution when the urinal 11 is used for the first time results in waste, while the lower concentration of cleaning solution after repeated flushing of the urinal 11 results in a less effective cleaning action.

SUMMARY OF THE INVENTION

Therefore, the object of the present invention is to provide a dispenser which can effectively dispense cleaning solution to a water tank.

Another object of the present invention is to provide a water tank which is capable of discharging a mixture of water and an effective amount of cleaning solution to a urinal (or toilet bowl).

According to one aspect of the present invention, a cleaning solution dispenser is to be installed in a water tank and comprises a container and a tubular flow regulator. The container receives cleaning solution therein and is formed with a downwardly opening outlet. The flow regulator extends into the outlet of the container and is divided by a partition plate into upper and lower chambers. The upper chamber has a closed top end and a surrounding wall formed with at least one radial port opening adjacent to the partition plate. The flow regulator further has first and second tubes which extend upwardly from the partition plate into the upper chamber. The second tube is shorter than the first tube and has a top end which is located at a level higher than that of the port opening. The first and second tubes communicate the upper chamber with the lower chamber. The lower chamber has an open bottom end. The cleaning solution in the container flows through the flow regulator via the port opening, the upper chamber, the second tube and the lower chamber when air pressure in the upper chamber is less than pressure in the container.

According to another aspect of the present invention, a water tank is capable of discharging a mixture of water and cleaning solution and comprises a tank body and a cleaning solution dispenser. The tank body receives water therein. The cleaning solution dispenser is installed in the tank body and includes a container and a tubular flow regulator. The container receives cleaning solution therein and is formed with a downwardly opening outlet. The flow regulator extends into the outlet of the container and is divided by a partition plate into upper and lower chambers. The upper chamber has a closed top end and a surrounding wall formed with at least one radial port opening adjacent to the partition plate. The flow regulator further has first and second tubes which extend upwardly from the partition plate into the upper chamber. The second tube is shorter than the first tube and has a top end which is located at a level higher than that of the port opening. The first and second tubes communicate the upper chamber with the lower chamber. The lower chamber has an open bottom end. The cleaning solution in the container flows through the flow regulator into the tank body via the port opening, the upper chamber, the second tube and the lower chamber when air pressure in the upper chamber is less than pressure in the container.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
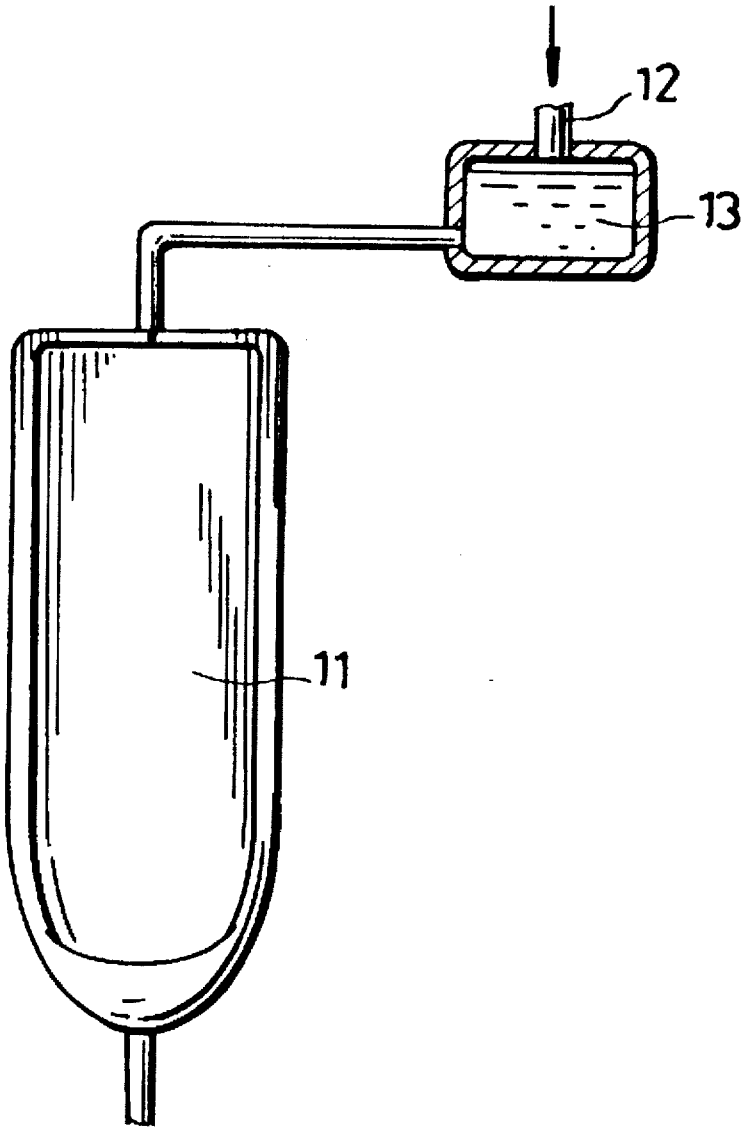
FIG. 1 PRIOR ART
FIG. 1 illustrates how cleaning solution is dispensed to a urinal in a conventional manner.
Figure 2:
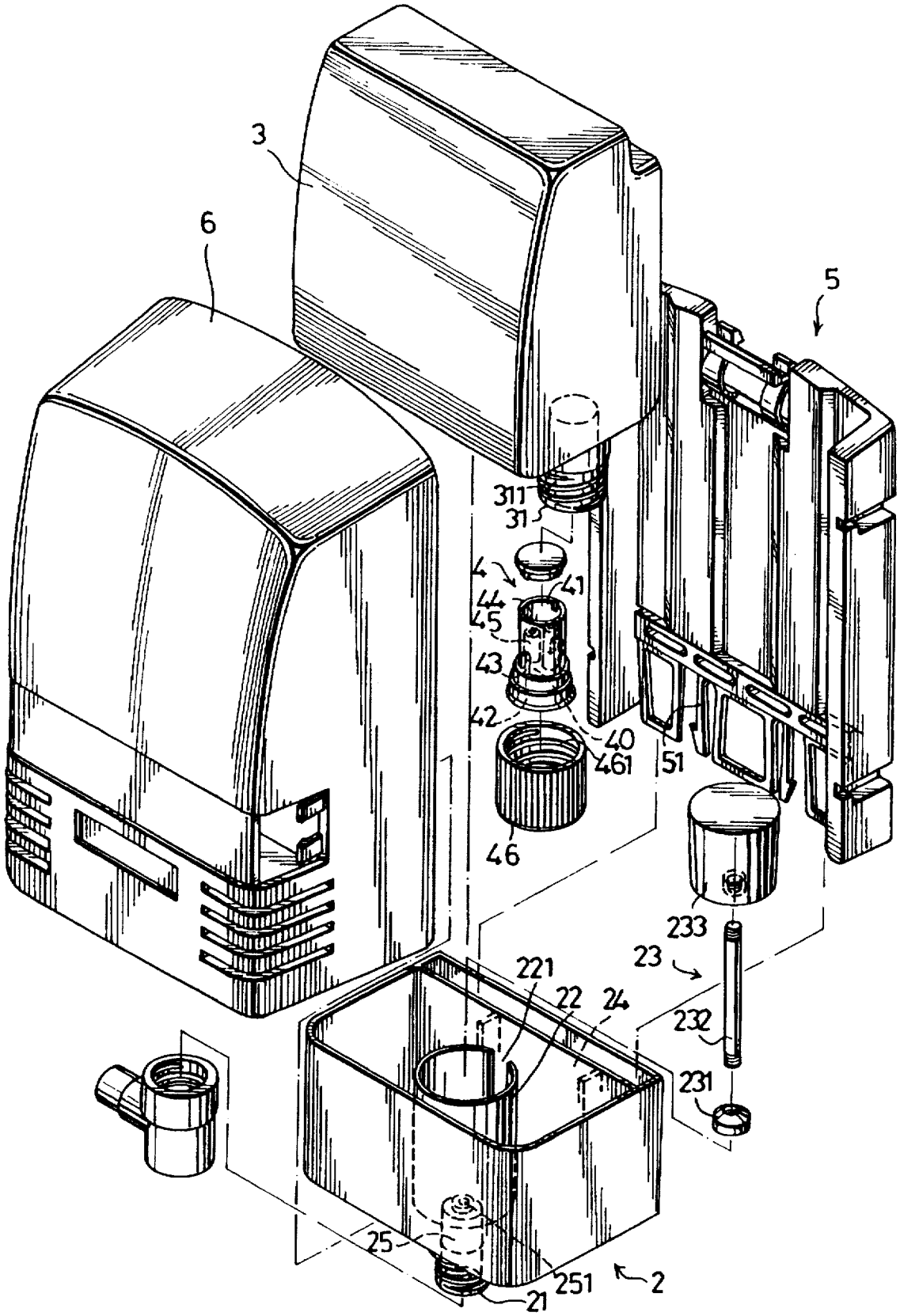
FIG. 2 is an exploded view of a water tank which incorporates the preferred embodiment of a cleaning solution dispenser according to the present invention.

Referring to FIG. 2, a water tank is shown to incorporate a cleaning solution dispenser which includes a container 3 and a tubular flow regulator 4.

The water tank has a tank body 2 with a bottom end formed with a water supply port 21 and an upright tubular float guide 22 which is coaxial with the water supply port 21. The float guide 22 is formed with an axially extending slit 221 and has a tubular valve seat 25 retained therein. A float valve 23 is disposed in the tank body 2 to control water flow through the water supply port 21. The float valve 23 includes a valve piece 231, a connecting shaft 232 and a float body 233. The float body 233 is disposed in the float guide 22 and is connected to an upper end of the connecting shaft 232. The connecting shaft 232 extends through a wider opening 251 formed in a top end of the valve seat 25 and has a lower end connected to the valve piece 231.

The container 3 contains cleaning solution therein and has a bottom end formed with a downwardly extending outlet 31. The outlet 31, which is configured as a pipe in this embodiment, is formed with an external screw thread 311.

The flow regulator 4 is divided by a partition plate 40 into upper and lower chambers 41, 42. The upper chamber 41 has a closed top end and a surrounding wall formed with at least one radial port opening 43 adjacent to the partition plate 40. In this embodiment, the upper chamber 41 is formed with a pair of diametrically opposite port openings 43. First and second tubes 44, 45 extend upwardly from the partition plate 40 into the upper chamber 41. The second tube 45 is shorter than the first tube 44 and has a top end which is located at a level higher than that of the port openings 43. The first and second tubes 44, 45 communicate the upper chamber 41 with the lower chamber 42. The lower chamber 42 has an open bottom end. In this embodiment, the container 3 is disposed on top of the tank body 2, and the flow regulator 4 extends into the outlet 31 of the container 3 such that the lower chamber 42 extends downwardly into the tank body 2. A tubular sleeve 46 is formed with an internal screw thread 461 for engaging the external screw thread 311 of the outlet 31. The tubular sleeve 46 is axially shiftable with respect to the flow regulator 4 to adjust the volume of space of the lower chamber 42.

The tank body 2 and the container 3 are preferably enclosed within a housing. In this embodiment, the housing includes a back plate 5 and a front cover 6. The tank body 2 has a rear end formed with an engaging slot 24 for engaging a lower insert end 51 of the back plate 5. The front cover 6 engages the back plate 5 to enclose the tank body 2 and the container 3 therebetween.

Figure 3:
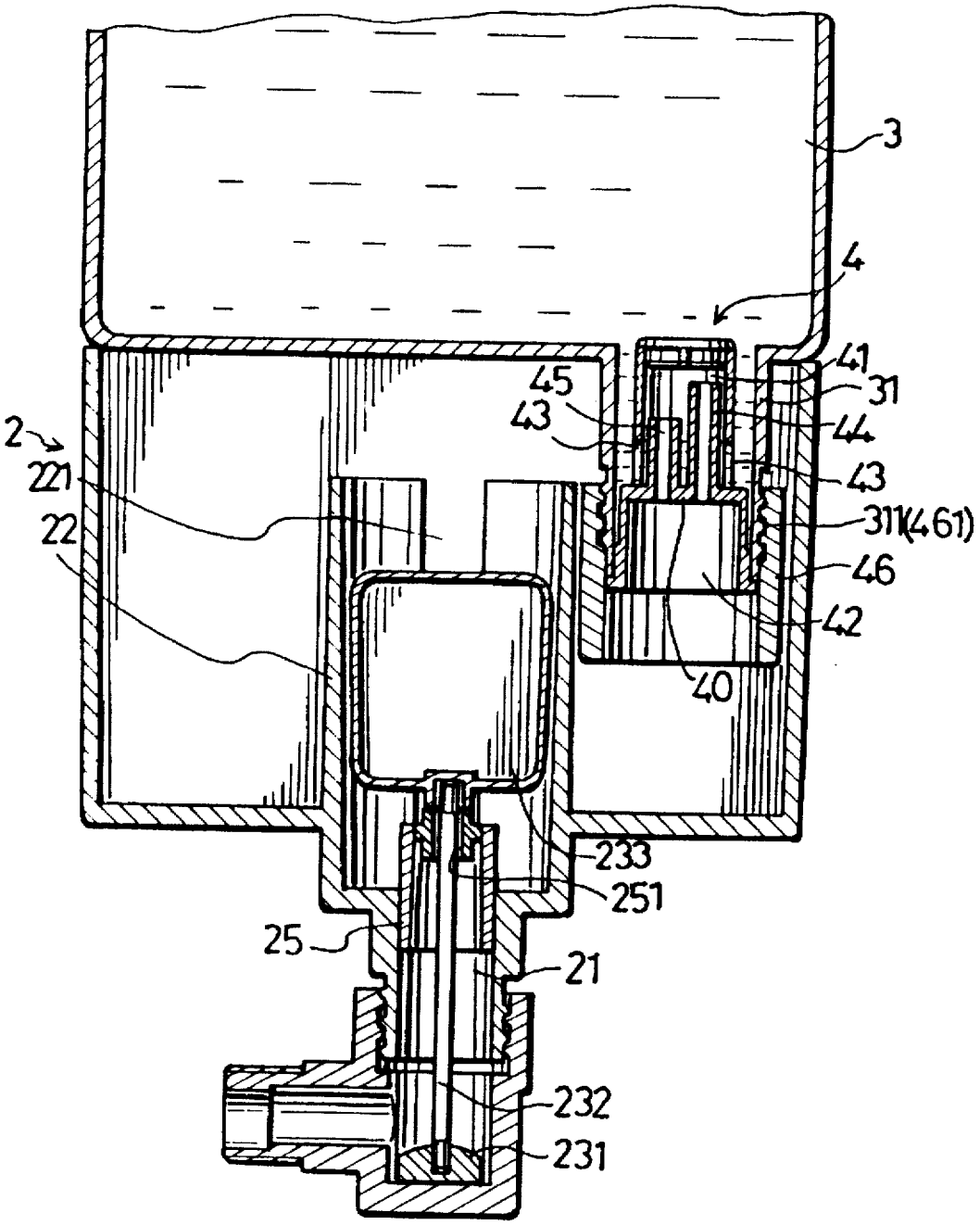
FIGS. 3 to 5 are sectional views which illustrate the operation of the preferred embodiment.
Figure 4:
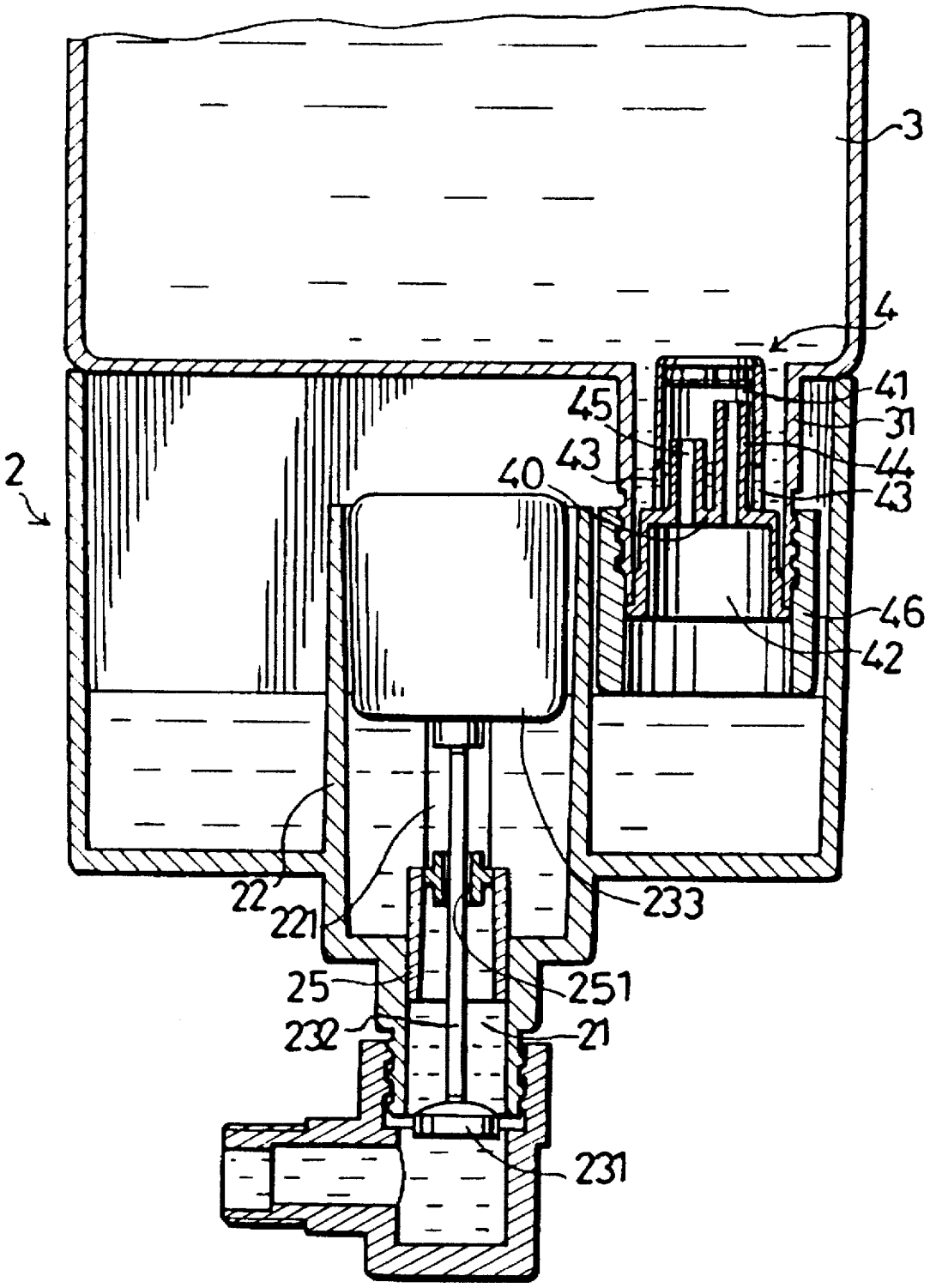
Figure 5:
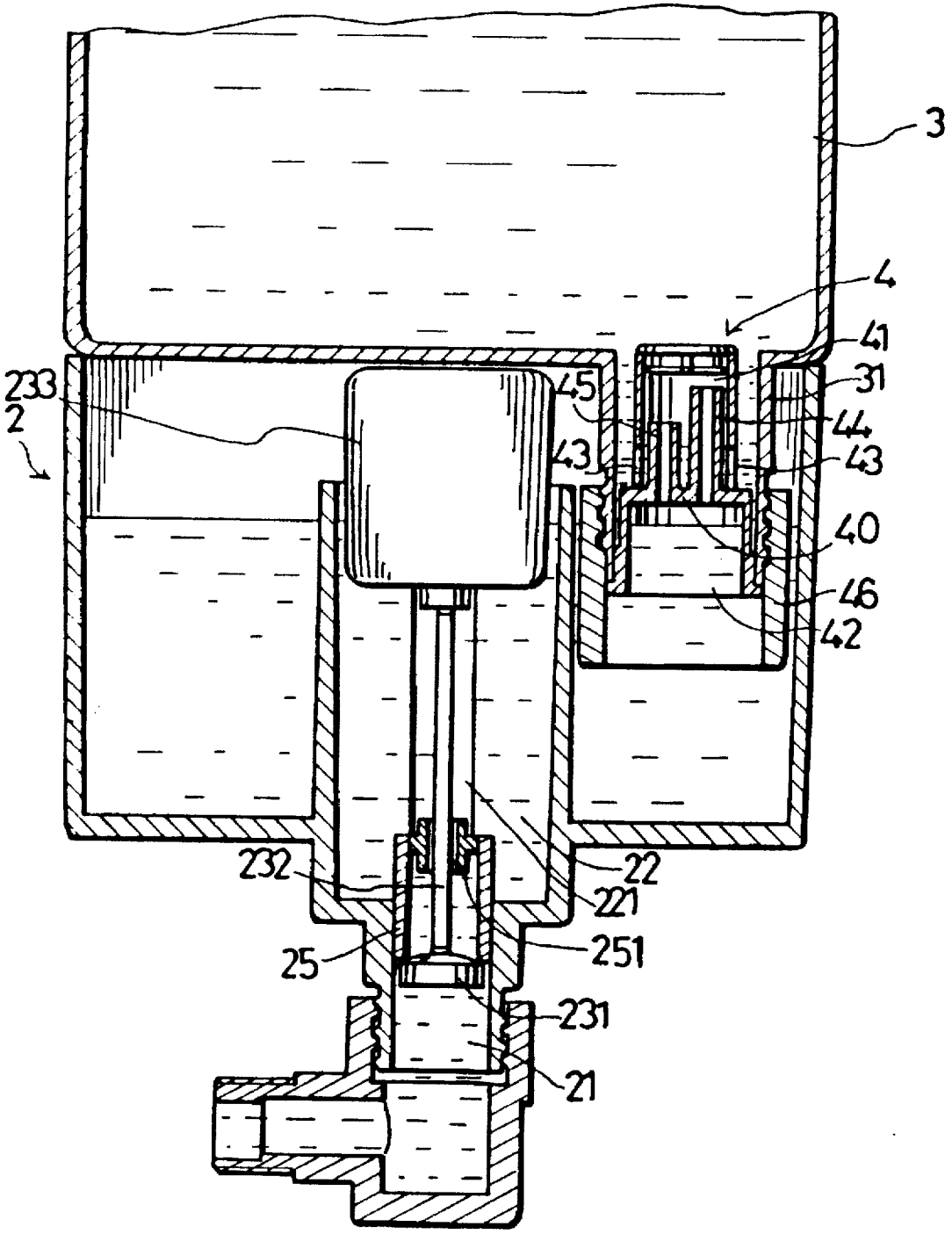

Referring to FIG. 3, in use, water flows into the tank body 2 via the water supply port 21. As the water level in the tank body 2 rises, the float body 233 rises therewith. When the water level reaches the bottom end of the tubular sleeve 46, as shown in FIG. 4, air in the flow regulator 4 is trapped therein. Continued rise of the water level in the tank body 2 compresses the air in the flow regulator 4 and in the tubular sleeve 46. When the pressure in the upper chamber 41 reaches a certain level, the air in the upper chamber 41 flows through the port openings 43, the cleaning solution and into the container 3 to maintain pressure equilibrium. Water will continue to flow into the tank body 2 until the valve piece 231 seals a bottom end of the valve seat 25, as shown in FIG. 5.

When the water in the tank body 2 is discharged in a known manner, the water level in the flow regulator 4 drops to result in a drop in the air pressure in the upper chamber 41. When air pressure in the upper chamber 41 is less than pressure in the container 3, cleaning solution is forced to flow through the flow regulator 4 into the tank body 2 via the port openings 43, the upper chamber 41, the second tube 45 and the lower chamber 42, thereby resulting in the discharge of a mixture of water and cleaning solution by the tank body 2. When the water level drops below the bottom end of the tubular sleeve 46, the air pressure in the upper chamber 41 rises to prevent further flow of cleaning solution through the flow regulator 4 to stop the dispensing of cleaning solution. This rise in air pressure in the upper chamber 41 is due to the flow of air in the tank body 2 through the first tube 44. The operating state of the preferred embodiment reverts to that shown in FIG. 3 at this time.

The tubular sleeve 46 serves to adjust the volume of space of the lower chamber 42 to adjust correspondingly the amount of cleaning solution that can be dispensed by the flow regulator 4 when the water in the tank body 2 is discharged.

The aforementioned water tank is suitable for use with a flushing system of a urinal. However, the cleaning solution dispenser can also be installed in the tank body of a toilet bowl (not shown) to achieve the effects of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A cleaning solution dispenser for installation in a sanitary appliance flush water tank (2), said cleaning solution dispenser comprising:

a container (3) for receiving a cleaning solution therein, said container being formed with a downwardly opening outlet (31); and a tubular flow regulator (4) disposed within said container outlet and divided by a partition plate (40) into upper and lower chambers (41, 42), said upper chamber having a closed top end and a surrounding wall formed with at least one radial port opening (43) adjacent to said partition plate, said flow regulator further having first and second tubes (44, 45) which extend upwardly from said partition plate into said upper chamber, said second tube being shorter than said first tube and having a top end located at a level higher than that of said port opening, said first and second tubes communicating said upper chamber with said lower chamber, said lower chamber having an open bottom end;

wherein the flow regulator extends downwardly into the flush water tank such that a rise in the water level in the tank after a flushing operation seals off the cleaning solution from entering the upper chamber and the second tube by an increase in the air pressure therein and a subsequent fall of the water level in the tank pursuant to a flushing operation exposes the open bottom end of the lower flow regulator chamber to attendantly cause the cleaning solution in said container to be dispensed through said flow regulator via said port opening, said upper chamber, said second tube, said lower chamber and into the flush water tank when the air pressure in said upper chamber is less than the air pressure in said container.

2. The cleaning solution dispenser as claimed in claim 1, further comprising a tubular sleeve (46) which is axially shiftable with respect to said flow regulator to adjust the volume of said lower chamber and attendantly the amount of dispensed cleaning solution.

3. A sanitary appliance flush water tank for discharging a mixture of water and cleaning solution, comprising:

a flush water tank body (2) for receiving water therein; and a cleaning solution dispenser installed in said tank body, said cleaning solution dispenser installed in said tank body, said cleaning solution dispenser including: a container (3) for receiving a cleaning solution therein, said container being formed with a downwardly opening outlet (31); and a tubular flow regulator (4) disposed within said container outlet and divided by a partition plate (40) into upper and lower chambers (41, 42), said upper chamber having a closed top end and a surrounding wall formed with at least one radial port opening (43) adjacent to said partition plate, said flow regulator further having first and second tubes (44, 45) which extend upwardly from said partition plate into said upper chamber, said second tube being shorter than said first tube and having a top end located at a level higher than that of said port opening, said first and second tubes communicating said upper chamber with said lower chamber, said lower chamber having an open bottom end;

wherein the flow regulator extends downwardly into the flush water tank such that a rise in the water level in the tank after a flushing operation seals off the cleaning solution from entering the upper chamber and the second tube by an increase in the air pressure therein and a subsequent fall of the water level in the tank pursuant to a flushing operation exposes the open bottom end of the lower flow regulator chamber to attendantly cause the cleaning solution in said container to be dispensed through said flow regulator via said port opening, said upper chamber, said second tube, said lower chamber and into the flush water tank when air pressure in said upper chamber is less than the air pressure in said container.

4. The flush water tank as claimed in claim 3, wherein said cleaning solution dispenser further comprises a tubular sleeve (46) which is axially shiftable with respect to said flow regulator to adjust the volume of said lower chamber and attendantly the amount of dispensed cleaning solution.

5. The flush water tank as claimed in claim 3, wherein said tank body is formed with a water supply port (21), said water tank further comprising a float valve (23) for controlling water flow through said water supply port.

6. The flush water tank as claimed in claim 5, wherein said float valve comprises a float body (233), a valve piece (231), and a connecting shaft (232), having opposite ends connected respectively to said float body and to said valve piece.

7. The flush water tank as claimed in claim 5, wherein said water supply port is formed in a bottom end of said tank body, said bottom end of said tank body being further formed with an upright tubular float guide (22) coaxial with said water supply port, said float guide being formed with an axially extending slit (221) and having a tubular valve seat (25) retained therein, said float valve including a float body disposed in said float guide, a connecting shaft extending through said valve seat and having an upper end connected to said float guide and a lower end, and a valve piece connected to said lower end of said connecting shaft.

8. The flush water tank as claimed in claim 3, further comprising a housing including a back plate (5) and a front cover (6) secured to said back plate, said housing mounting said tank body and said cleaning solution dispenser therein.

* * * * *